US011612979B2

(12) United States Patent
Kojima et al.

(10) Patent No.: US 11,612,979 B2
(45) Date of Patent: Mar. 28, 2023

(54) POLISHING PAD

(71) Applicant: DISCO CORPORATION, Tokyo (JP)

(72) Inventors: Katsuyoshi Kojima, Tokyo (JP); Arisa Kuroda, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 699 days.

(21) Appl. No.: 16/541,708

(22) Filed: Aug. 15, 2019

(65) Prior Publication Data

US 2020/0061773 A1 Feb. 27, 2020

(30) Foreign Application Priority Data

Aug. 22, 2018 (JP) ..... JP2018-155656

(51) Int. Cl.
*B24B 37/26* (2012.01)

(52) U.S. Cl.
CPC ..... *B24B 37/26* (2013.01)

(58) Field of Classification Search
CPC ..... B24B 37/20; B24B 37/22; B24B 37/24; B24B 37/26
See application file for complete search history.

(56) References Cited

U.S. PATENT DOCUMENTS 2,089,040 A * 8/1937 Shue ..... B24D 7/10 29/DIG. 68
4,918,872 A * 4/1990 Sato ..... B24B 37/26 451/450
6,056,851 A * 5/2000 Hsieh ..... B24B 57/02 451/527
2005/0260929 A1* 11/2005 Shiho ..... B24B 37/26 451/41
2008/0220702 A1* 9/2008 Feng ..... B24B 37/26 451/527
2013/0189907 A1* 7/2013 Kubo ..... B24B 37/26 451/527
2017/0047237 A1* 2/2017 Kobata ..... H01L 21/30625
2017/0209979 A1* 7/2017 Chang ..... B24B 37/26

FOREIGN PATENT DOCUMENTS

JP 08099265 A 4/1996
JP 2000288881 A 10/2000
JP 2001071256 A * 3/2001 ..... B23K 26/364
JP 2011235425 A * 11/2011 ..... B24B 47/10
WO WO-2005023487 A1 * 3/2005 ..... B24B 37/26

* cited by examiner

*Primary Examiner* — Joel D Crandall
(74) *Attorney, Agent, or Firm* — Greer Burns & Crain Ltd.

(57) ABSTRACT

A polishing pad has a disk-shaped substrate and a polishing layer of which an upper surface side is adhered to the substrate. The polishing layer includes a plurality of through-holes which penetrate the polishing pad vertically and which are supplied with a polishing liquid, and a plurality of grooves which are formed on the lower surface side of the polishing pad and which are connected to the through-holes. The plurality of through-holes are formed such as to surround the center of the polishing layer, and the plurality of grooves are formed radially from the plurality of through-holes toward the outer periphery of the polishing layer.

7 Claims, 8 Drawing Sheets

POLISHING PAD

BACKGROUND OF THE INVENTION

Field of the Invention

The present invention relates to polishing pad for use in polishing a workpiece.

Description of the Related Art

A wafer formed with devices such as integrated circuits (ICs) and large scale integrations (LSIs) on a front surface side thereof is divided along streets, whereby a plurality of chips each including the device are obtained. The chips are incorporated in various electronic apparatuses. In recent years, attendant on reductions in the size and thickness of electronic apparatuses, the chips have also been demanded to be reduced in size and thickness. In view of this, a technique of thinning the chips by grinding the back surface side of the wafer by a plurality of grindstones have been used. For the grinding, a grinding apparatus equipped with a plurality of grindstones are used. For instance, Japanese Patent Laid-open No. 2000-288881 discloses a grinding apparatus that grinds a wafer by use of a plurality of grindstones for rough grinding that include abrasive grains of a large particle size and a plurality of grindstones for finished grinding that include abrasive grains of a small particle size.

When the back surface side of a wafer is ground by the grindstones, minute ruggedness (projections and recesses) or cracks may be formed in the ground region. When a region where the ruggedness or cracks are formed (strained layer) is present, the die strength of the chips obtained by dividing the wafer is lowered, and, therefore, it is desired that the strained layer is removed after the grinding. The removal of the strained layer is conducted, for example, by polishing the back surface side of the wafer by use of a polishing apparatus. Japanese Patent Laid-open No. Hei 8-99265 discloses a polishing apparatus which includes a chuck table for holding a wafer, and a polishing unit (polishing means) polishing the wafer held by the chuck table. The polishing unit possessed by the polishing apparatus is equipped with a disk-shaped polishing pad for polishing the wafer. At the time of polishing, the polishing pad is brought into contact with the wafer while being rotated. In addition, at the time of polishing the wafer, a polishing liquid is supplied to the area between the polishing pad and the wafer by way of a through-hole (polishing liquid supply passage) formed in a central portion of the polishing pad. As the polishing liquid, there is used, for example, a chemical liquid (slurry) in which free abrasive grains are dispersed. The polishing liquid acts on the wafer chemically and mechanically, whereby the wafer is polished.

SUMMARY OF THE INVENTION

At the time of polishing a wafer by use of the polishing apparatus, the polishing pad is positioned such as to make contact with the whole part of a surface to be processed of the wafer held by the chuck table. Here, in the case where the diameter of the wafer is comparatively large, the polishing liquid supply passage formed in the central portion of the polishing pad is covered by the wafer, so that the polishing liquid is easily supplied to the surface to be processed of the wafer via the polishing liquid supply passage. On the other hand, where the diameter of the wafer is small, even if the polishing pad is positioned such as to make contact with the whole part of the surface to be processed of the wafer, the polishing liquid supply passage may be in an exposed state without being covered by the wafer. In this case, most part of the polishing liquid supplied to the polishing liquid supply passage may flow out without being supplied to the surface to be processed of the wafer, and the supply of the polishing liquid to the area between the polishing pad and the wafer may be insufficient. As a result, a trouble that the polishing of the wafer is not suitably performed, a trouble that the swarf generated by polishing (polishing swarf) is not suitably discharge, or the like may be generated, so that defective processing may be liable to occur.

The present invention has been made in consideration of the above-mentioned problem. Accordingly, it is an object of the present invention to provide a polishing pad by which a polishing liquid can be supplied suitably.

In accordance with an aspect of the present invention, there is provided a polishing pad having a disk-shaped substrate and a polishing layer of which an upper surface side is adhered to the substrate, in which the polishing layer includes a plurality of through-holes which are formed to penetrate the polishing layer vertically and which are supplied with a polishing liquid, and a plurality of grooves which are formed on a lower surface side of the polishing layer and which are connected to the through-holes, the plurality of through-holes are formed such as to surround a center of the polishing layer, and the plurality of grooves are formed radially from the plurality of through-holes toward an outer periphery of the polishing layer.

Note that a plurality of concentric circular grooves connected to the grooves may be formed in a region on the lower surface side of the polishing pad which region is located on the outer periphery side of the polishing pad as compared to the plurality of through-holes. In addition, the grooves connected to the through-holes may be formed such as not to reach the outer periphery of the polishing layer.

The polishing pad according to the described aspect of the present invention includes the plurality of through-holes formed to penetrate the polishing layer vertically, and the plurality of grooves which are formed on the lower surface side of the polishing layer and which are connected to the through-holes. With this polishing pad used, the polishing liquid is easily supplied to the whole region on the lower surface side of the polishing layer via the grooves, and the polishing liquid can be suitably supplied to the area between the polishing layer and the workpiece.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
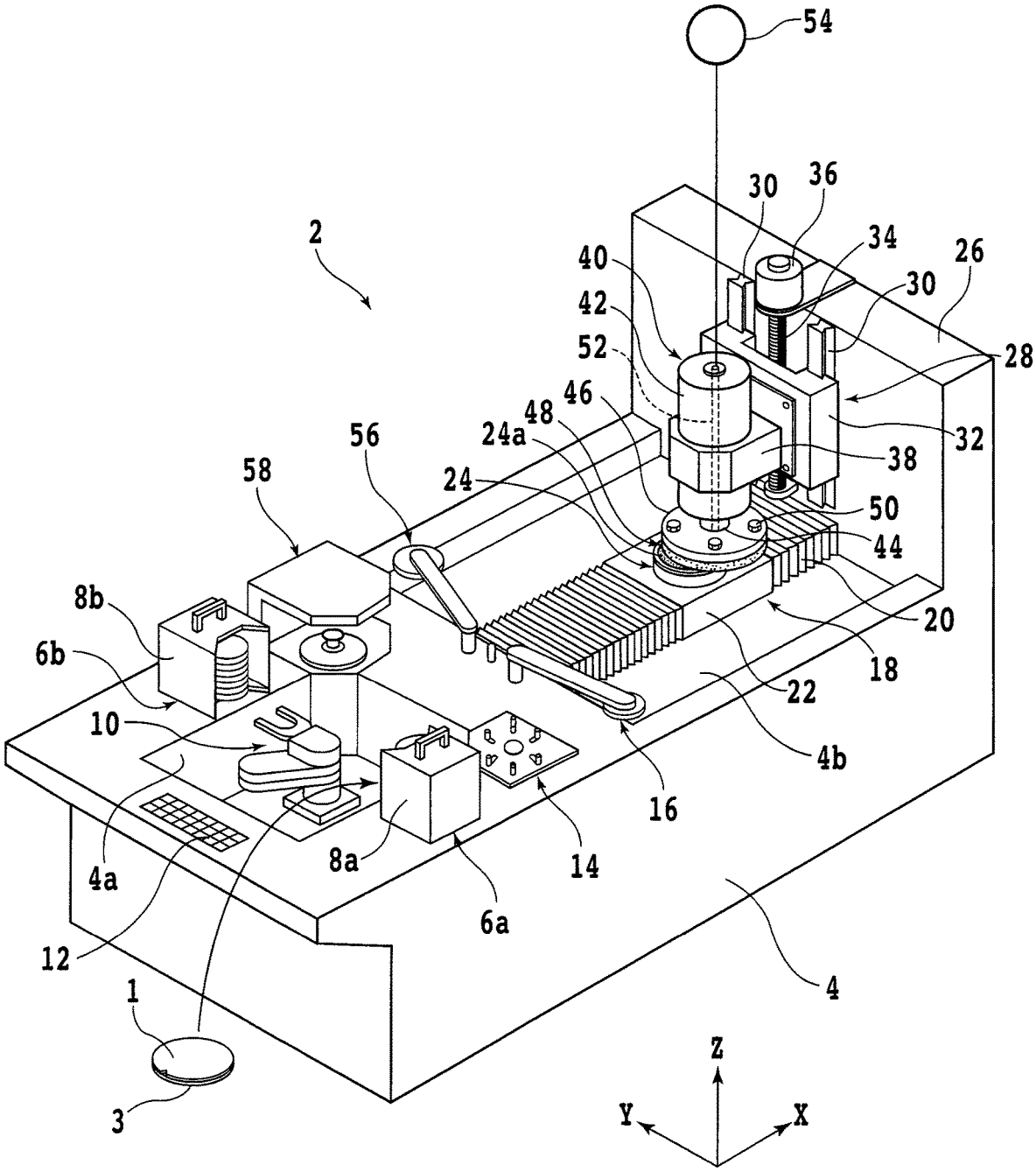
FIG. 1 is a perspective view depicting a configuration example of a polishing apparatus.

An embodiment of the present invention will be described below referring to the attached drawings. FIG. 1 is a perspective view depicting a configuration example of a polishing apparatus to which a polishing pad according to the present embodiment is mounted. The polishing apparatus 2 is a processing apparatus for polishing a workpiece 1 by a polishing pad.

The workpiece 1 to be polished by the polishing apparatus 2 includes, for example, a disk-shaped wafer or the like formed with devices (not illustrated) such as ICs and LSIs on a front surface side thereof. The material, shape, structure, size and the like of the workpiece 1 are not limited, and, for example, a wafer formed of a semiconductor (silicon, GaAs, InP, GaN, SiC, etc.), glass, sapphire, ceramic, resin, metal or the like can be used as the workpiece 1. In addition, the workpiece 1 may be a wafer of lithium tantalate or lithium niobate. Besides, the kind, number, shape, structure, size, layout and the like of the devices are not limited.

The workpiece 1 is partitioned into a plurality of regions by a plurality of streets arranged in a grid pattern such as to intersect each other, and devices are formed in the plurality of regions. By dividing the workpiece 1 along the streets, a plurality of chips each including the device are obtained. For the purpose of thinning the chips, the workpiece 1 before divided may be subjected to grinding. Specifically, the back surface side of the workpiece 1 is ground by a plurality of grindstones, to thin the workpiece 1. However, when the back surface side of the workpiece 1 is ground by the grindstones, minute ruggedness (projections and recesses) and/or cracks may be formed in the ground region. When the region (strained layer) in which the ruggedness and/or the cracks are formed is present, the die strength of the chips obtained by dividing the workpiece 1 is lowered, and, therefore, it is preferable that the strained layer is removed after grinding. The polishing apparatus 2 is used, for example, for removing the strained layer. Specifically, the back surface side of the workpiece 1 is polished by the polishing apparatus 2, whereby the strained layer is removed. As a result, a lowering in the die strength of the chips is restrained.

At the time of polishing the back surface side of the workpiece 1, a protective tape 3 for protecting the devices is adhered to the front surface side of the workpiece 1. The protective tape 3 includes, for example, a flexible film-shaped substrate, and a glue layer (adhesive layer) formed on the substrate. For the substrate, there may be used, for example, polyolefins (PO), polyethylene terephthalate (PET), polyvinyl chloride, polystyrene and the like. In addition, for the glue layer, there may be used, for example, silicone rubber, acrylic materials, epoxy materials and the like.

The polishing apparatus 2 includes a base 4 that supports components of the polishing apparatus 2. On the front side on the base 4, cassette mounting bases 6*a* and 6*b* are provided. For example, a cassette 8*a* in which to accommodate the workpieces 1 before polishing is mounted on the cassette mounting base 6*a*, and, for example, a cassette 8*b* in which to accommodate the workpieces 1 after polishing is mounted on the cassette mounting base 6*b*. An opening 4*a* is formed in a region between the cassette mounting base 6*a* and the cassette mounting base 6*b*. In the opening 4*a*, a first conveying mechanism 10 for conveying the workpiece 1 is provided. In addition, in a region on the front side of the opening 4*a*, an operation panel 12 for inputting polishing conditions and the like is disposed.

On an oblique rear side of the first conveying mechanism 10, a position adjusting mechanism 14 for adjusting the position of the workpiece 1 is provided. The workpiece 1 accommodated in the cassette 8*a* is conveyed onto the position adjusting mechanism 14 by the first conveying mechanism 10, and the position of the workpiece 1 is adjusted by the position adjusting mechanism 14. Besides, in the vicinity of the position adjusting mechanism 14, a second conveying mechanism (loading arm) 16 for holding and slewing the workpiece 1 is disposed.

On an upper surface side of the base 4 located on the rear side of the second conveying mechanism 16, an opening 4*b* rectangular in shape in plan view is provided. The opening 4*b* is formed such that its longitudinal direction is along an X-axis direction (front-rear direction). A ball screw type X-axis moving mechanism 18 and a dustproof droplet-proof cover 20 covering part of the X-axis moving mechanism 18 are disposed in the opening 4*b*. In addition, the X-axis moving mechanism 18 includes a moving table 22, and the position of the moving table 22 in the X-axis direction is controlled by the X-axis moving mechanism 18.

A chuck table 24 that holds the workpiece 1 is provided on the moving table 22, and an upper surface of the chuck table 24 constitutes a holding surface 24*a* that holds the workpiece 1. Note that an example in which the holding surface 24*a* is formed in a circular shape in plan view is depicted in FIG. 1 by assuming that particularly a disk-shaped workpiece 1 is to be held, the shape of the holding surface 24*a* can be appropriately modified according to the shape of the workpiece 1 or the like. The holding surface 24*a* is connected to a suction source (not illustrated) through a suction passage (not illustrated) formed inside the chuck table 24. The workpiece 1 disposed on the position adjusting mechanism 14 is conveyed onto the holding surface 24*a* of the chuck table 24 by the second conveying mechanism 16, and a negative pressure of the suction source is made to act on the holding surface 24*a*, whereby the workpiece 1 is suction held by the chuck table 24. When the moving table 22 is moved by the X-axis moving mechanism 18, the chuck table 24 is moved in the X-axis direction together with the moving table 22. In addition, the chuck table 24 is connected to a rotational drive source (not illustrated) such as a motor, and is rotated around a rotational axis which is substantially parallel to a Z-axis direction (vertical direction).

A support structure 26 having a rectangular parallelepiped shape is provided at a rear end of the base 4, and a Z-axis moving mechanism 28 is provided on a front surface side of the support structure 26. The Z-axis moving mechanism 28 includes a pair of Z-axis guide rails 30 provided along the Z-axis direction on the front surface side of the support structure 26, and a Z-axis moving plate 32 is mounted to the pair of Z-axis guide rails 30 in the manner of being slidable along the Z-axis direction. A nut section (not illustrated) is provided on a rear surface side (back surface side) of the Z-axis moving plate 32, and the nut section is in screw engagement with a Z-axis ball screw 34 disposed along a direction substantially parallel to the Z-axis guide rails 30. In addition, a Z-axis pulse motor 36 is connected to one end portion of the Z-axis ball screw 34. When the Z-axis ball screw 34 is rotated by the Z-axis pulse motor 36, the Z-axis moving plate 32 is moved in the Z-axis direction along the Z-axis guide rails 30.

A support tool 38 projecting forward is provided on the front surface side of the Z-axis moving plate 32, and the support tool 38 supports a polishing unit (polishing means)

40 polishing the workpiece 1. The polishing unit 40 includes a spindle housing 42 fixed to the support tool 38, and a spindle 44 serving as a rotary shaft is accommodated in a rotatable state in the spindle housing 42. A tip portion (lower end portion) of the spindle 44 is exposed to the exterior of the spindle housing 42, and a disk-shaped mount 46 is fixed to the tip portion of the spindle 44. In addition, a disk-shaped polishing pad 48 configured to be substantially equal in diameter to the mount 46 is mounted to a lower surface side of the mount 46. The mounting of the polishing pad 48 is conducted, for example, by fixing the mount 46 and the polishing pad 48 by bolts 50. It is to be noted, however, that the mounting method for the polishing pad 48 is not limited.

At the time of polishing the workpiece 1, first, the workpiece 1 is suction held by the chuck table 24 in such a manner that the surface to be polished (surface to be processed) by the polishing unit 40 is exposed to the upper side. Then, the chuck table 24 is moved by the X-axis moving mechanism 18, to position the chuck table 24 at a position beneath the polishing pad 48. Thereafter, while rotating the chuck table 24 and the spindle 44 at predetermined rotating speeds in predetermined directions, the polishing pad 48 is lowered at a predetermined speed, to bring the polishing pad 48 into contact with the surface to be processed of the workpiece 1. As a result, the workpiece 1 is polished by the polishing pad 48. The polishing unit 40 is formed therein with a polishing liquid supply passage 52 penetrating the polishing unit 40 in the Z-axis direction, and one end side of the polishing liquid supply passage 52 is connected to a polishing liquid supply source 54. At the time of polishing the workpiece 1 suction held on the chuck table 24 by the polishing pad 48, a polishing liquid is supplied from the polishing liquid supply source 54 to the workpiece 1 and the polishing pad 48 through the polishing liquid supply passage 52.

At a position adjacent to the second conveying mechanism 16, a third conveying mechanism (unloading arm) 56 for holding and slewing the workpiece 1 is disposed. In addition, a cleaning mechanism 58 for cleaning the workpiece 1 is disposed on the front side of the third conveying mechanism 56. The workpiece 1 polished by the polishing unit 40 is conveyed to the cleaning mechanism 58 by the third conveying mechanism 56, and is cleaned by the cleaning mechanism 58. Then, the workpiece 1 after cleaned is conveyed by the first conveying mechanism 10, and is accommodated into the cassette 8*b*.

Figure 2:
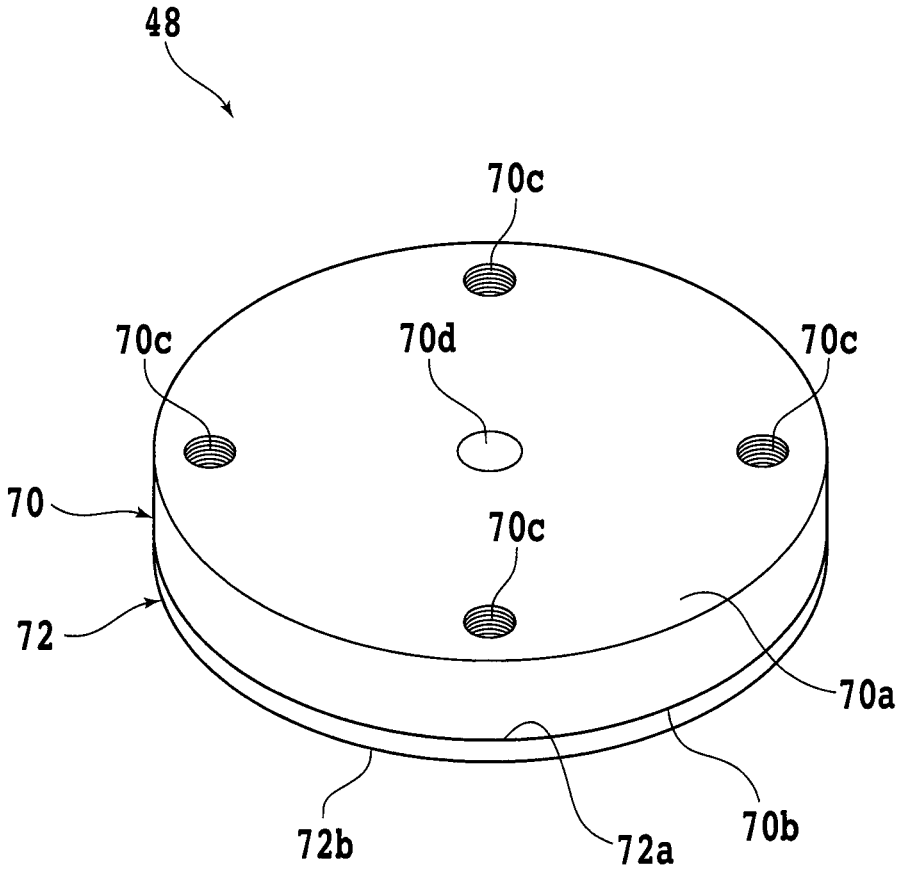
FIG. 2 is a perspective view depicting a polishing pad.

FIG. 2 is a perspective view depicting the polishing pad 48 mounted to the polishing unit 40. The polishing pad 48 includes a disk-shaped substrate 70 formed of a metallic material such as stainless steel and aluminum and a resin such as polyphenylene sulfide (PPS). The substrate 70 includes an upper surface 70*a* fixed to the mount 46, and a lower surface 70*b* substantially parallel to the upper surface 70*a*. The substrate 70 is formed on the upper surface 70*a* side thereof with a plurality of tapped holes 70*c* in which to insert the bolts 50 (see FIG. 1) for fixing the mount 46 and the polishing pad 48. The plurality of tapped holes 70*c* are formed substantially at regular intervals along a circumferential direction of the substrate 70. Note that the number of the tapped holes 70*c* is not limited. The substrate 70 is formed in a central portion thereof with a cylindrical through-hole 70*d* penetrating the substrate 70 from the upper surface 70*a* to the lower surface 70*b*. This through-hole 70*d* corresponds to part of the polishing liquid supply passage 52 (see FIG. 1) formed in the polishing unit 40. Note that the size of the through-hole 70*d* is not limited; for example, the through-hole 70*d* is formed to have a diameter of approximately 10 to 50 mm.

A polishing layer 72 for polishing the workpiece 1 is fixed on the lower surface 70*b* side of the substrate 70. The polishing layer 72 is formed in a disk-like shape substantially equal in diameter to the substrate 70, and includes an upper surface 72*a* fixed to the lower surface 70*b* side of the substrate 70, and a lower surface 72*b* substantially parallel to the upper surface 72*a*. The lower surface 72*b* of the polishing layer 72 constitutes a surface (polishing surface) for polishing the surface to be processed of the workpiece 1. The polishing layer 72 is, for example, adhered to the lower surface 70*b* side of the substrate 70 through an adhesive or the like. The polishing layer 72 is formed, for example, by dispersing abrasive grains (fixed abrasive grains) in a non-woven fabric or polyurethane foam. As the abrasive grains, there can be used, for example, those of silica having a particle diameter of 0.1 to 10 μm. It is to be noted, however, that the particle diameter, material and the like of the abrasive grains can be appropriately modified according to the material of the workpiece 1 and the like. In the case where the abrasive grains are included in the polishing layer 72, a polishing liquid not containing abrasive grains is used as the polishing liquid supplied from the polishing liquid supply source (see FIG. 1). As the polishing liquid, there can be used, for example, alkaline solutions containing sodium hydroxide, potassium hydroxide or the like dissolved therein or acidic liquids of permanganate or the like. In addition, pure water can also be used as the polishing liquid. On the other hand, the polishing layer 72 may not include abrasive grains. In this case, a chemical liquid (slurry) in which abrasive grains (free abrasive grains) are dispersed is used as the polishing liquid supplied from the polishing liquid supply source 54 (see FIG. 1). The material of the chemical liquid, the material of the abrasive grains, the particle diameter of the abrasive grains and the like are appropriately selected according to the material of the workpiece 1 or the like.

At the time of polishing the workpiece 1, the polishing pad 48 is rotated by rotating the spindle 44 in a state in which the polishing pad 48 is mounted to the mount 46, as depicted in FIG. 1. Then, while supplying the polishing liquid from the polishing liquid supply source 54 to the area between the polishing pad 48 and the workpiece 1 through the polishing liquid supply passage 52, the polishing pad 48 in rotation is pressed against the surface to be processed of the workpiece 1 held by the chuck table 24. As a result, the surface to be processed of the workpiece 1 is polished by the lower surface 72*b* (polishing surface) of the polishing layer 72.

At the time of polishing the workpiece 1, the polishing layer 72 of the polishing pad 48 makes contact with the whole part of the surface to be processed of the workpiece 1. Here, in the case where, for example, the diameter of the workpiece 1 is greater than the radius of the polishing surface 72, a lower end of the polishing liquid supply passage 52 is covered by the workpiece 1, so that the polishing liquid is liable to be supplied to the surface to be processed of the workpiece 1 through the polishing liquid supply passage 52. On the other hand, in the case where, for example, the diameter of the workpiece 1 is smaller than the radius of the polishing layer 72, the lower end of the polishing liquid supply passage 52 is not covered by the workpiece 1 but is in an exposed state. When the polishing liquid is supplied to the polishing liquid supply passage 52 in this state, most part of the polishing liquid would flow out without being supplied to the surface to be processed of the workpiece 1, possibly resulting in insufficient supply of the polishing liquid to the area between the workpiece 1 and the polishing pad 48. As a result, a trouble that polishing of the workpiece 1 is not performed suitably, a trouble that swarf generated by polishing (polishing sward) is not suitably discharged, or the like may be generated, and defective processing is liable to occur.

The polishing pad 48 according to the present embodiment includes a plurality of through-holes formed such as to penetrate the polishing layer 72 vertically, and a plurality of grooves which are formed on the lower surface 72*b* side of the polishing layer 72 and are connected to the through-holes. With this polishing pad 48 used, the polishing liquid is easily supplied to the whole region on the lower surface 72*b* side of the polishing layer 72 through the grooves, so that the polishing liquid can be suitably supplied to the area between the polishing layer 72 and the workpiece 1.

Figure 3:
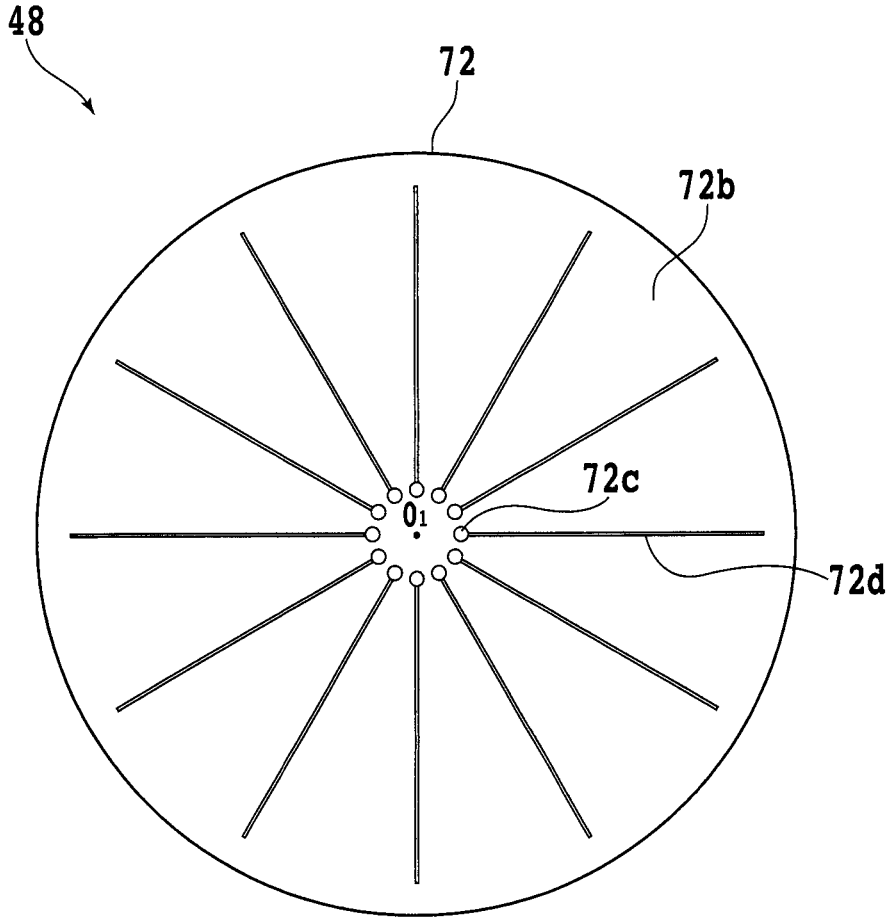
FIG. 3 is a bottom view depicting the polishing pad.

FIG. 3 is a bottom view depicting the polishing pad 48. The polishing layer 72 is formed in its central portion with the plurality of through-holes 72*c* which penetrate the polishing layer 72 from the upper surface 72*a* to the lower surface 72*b* and which are arranged such as to surround the center $O_1$ of the polishing layer 72. The plurality of through-holes 72*c* are formed, for example, in a cylindrical shape, and are arranged at regular intervals along the circumference (outer periphery) of a circle having a predetermined diameter with the center $O_1$ of the polishing layer 72 as the center of the circle.

Note that the plurality of through-holes 72*c* are formed at such positions as to overlap with the through-hole 70*d* (see FIG. 2) of the substrate 70, that is, formed in the region inside of the through-hole 70*d* in bottom view. In other words, the through-hole 70*d* and the plurality of through-holes 72*c* are coupled with each other. In addition, the polishing layer 72 is formed on its lower surface 72*b* side with the plurality of linear grooves 72*d* which are connected to the through-holes 72*c* and the depth of which is less than the thickness of the polishing layer 72. The plurality of grooves 72*d* are each formed rectilinearly from the through-hole 72*c* toward the outer periphery of the polishing layer 72. In other words, the plurality of grooves 72*d* are formed radially in bottom view. It is to be noted, however, that the plurality of grooves 72*d* are each formed such as not to reach the outer periphery of the polishing layer 72.

The size of the through-holes 72*c*, the number of the through-holes 72*c*, the depth of the grooves 72*d*, the width of the grooves 72*d*, and the like are appropriately set according to the processing conditions or the like. For instance, the diameter of the through-holes 72*c* may be approximately 3 mm, and the number of the through-holes 72*c* may be 4 to 16. In addition, for example, the depth of the grooves 72*d* may be 0.5 to 3.0 mm, and the width of the grooves 72*d* may be 0.5 to 3.0 mm. Note that while an example in which the grooves 72*d* are rectilinearly formed is depicted in FIG. 3, the shape of the grooves 72*d* is not limited. For example, the grooves 72*d* may be in the shape of a curved line (sine wave, circular arc, etc.) or in the shape of a broken line (triangular wave, saw teeth, etc.).

Figure 4:
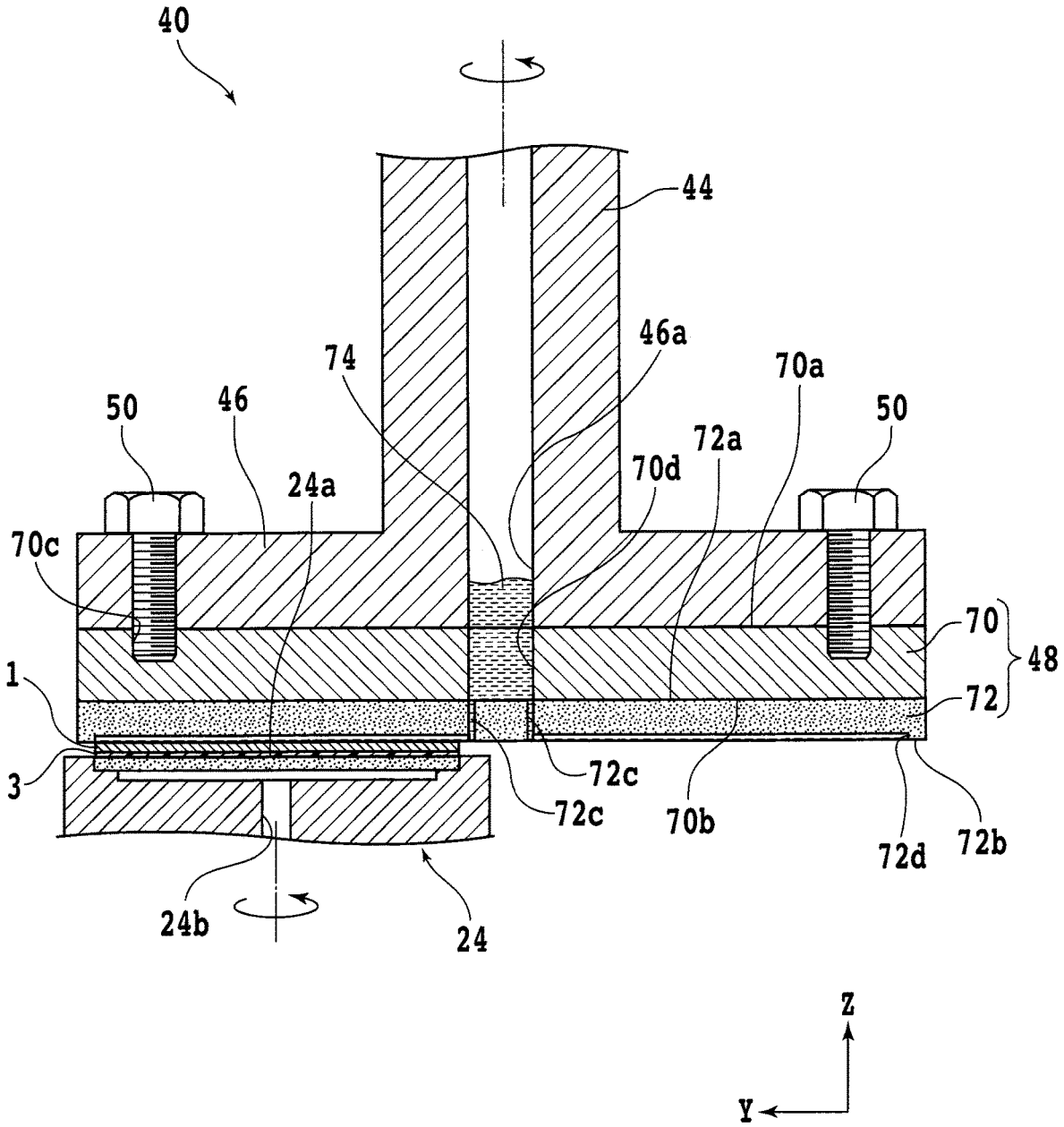
FIG. 4 is a sectional view depicting a polishing unit.

FIG. 4 is a sectional view depicting the polishing unit 40 in a state in which the polishing pad 48 is mounted to the mount 46. As illustrated in FIG. 4, the polishing pad 48 is fixed to the lower surface side of the mount 46 by bolts 50 inserted in the tapped holes 70*c*. The mount 46 is formed in its central portion with a cylindrical through-hole 46*a* substantially equal in diameter to the through-hole 70*d* of the substrate 70, and, when the polishing pad 48 is mounted to the mount 46, the through-hole 46*a* and the through-hole 70*d* are coupled with each other. Then, the through-holes 46*a*, 70*d* and 72*c* constitute part of the polishing liquid supply passage 52 (see FIG. 1).

At the time of polishing the workpiece 1, first, the workpiece 1 is disposed on the holding surface 24*a* of the chuck table 24 through the protective tape 3. Then, a negative pressure of the suction source (not illustrated) is made to act on the holding surface 24*a* through the suction passage 24*b* formed inside the chuck table 24. As a result, the workpiece 1 is suction held by the chuck table 24. Thereafter, the chuck table 24 is moved to a position beneath the polishing unit 40, and the chuck table 24 is positioned such that the whole part of the workpiece 1 overlaps with the polishing layer 72 of the polishing pad 48. Note that FIG. 4 depicts an example in which the diameter of the workpiece 1 is smaller than the radius of the polishing layer 72 and the workpiece 1 is positioned such as not to overlap with the through-holes 72*c*. Then, while rotating the mount 46 and the chuck table 24 around rotational axes substantially parallel to the Z-axis direction (vertical direction) and while supplying the polishing liquid 74 from the polishing liquid supply source 54 (see FIG. 1) to the polishing liquid supply passage 52, the polishing unit 40 is moved downward. In this instance, the polishing liquid 74 supplied from the polishing liquid supply source 54 is supplied to the through-holes 72*c* via the through-hole 46*a* and the through-hole 70*d*. Then, when the polishing layer 72 of the polishing pad 48 makes contact with the workpiece 1, the workpiece 1 is polished.

As depicted in FIG. 4, part (central part) of the lower end of the through-hole 70*d* formed in the substrate 70 is covered with the polishing layer 72, and flow rate of the polishing liquid 74 supplied from the through-hole 70*d* to the lower surface 72*b* side of the polishing layer 72 is restricted. Therefore, in the case where the diameter of the workpiece 1 is small and the workpiece 1 does not overlap with the through-hole 70*d*, the amount of the polishing liquid 74 which would flow out to the lower side of the polishing layer 72 without being supplied to the workpiece 1 is suppressed. In addition, the grooves 72*d* connected to the lower end portions of the through-holes 72*c* are formed on the lower surface 72*b* side of the polishing layer 72, so that the polishing liquid 74 reaching the lower end portions of the through-holes 72*c* is moved toward the outer side in regard of the radial direction of the lower surface 72*b* of the polishing layer 72 through the inside of the grooves 72*d* by centrifugal forces. In other words, the grooves 72*d* serves as passages for the polishing liquid 74, and the polishing liquid 74 is easily supplied to the area between the polishing pad 48 and the workpiece 1. Thus, when the polishing layer 72 formed with the through-holes 72*c* and the grooves 72*d* is used, the polishing liquid 74 is easily supplied to the area between the workpiece 1 and the polishing pad 48. As a result, polishing is performed suitably, and the polishing swarf is discharged suitably. In addition, the grooves 72*d* are formed such as not to reach the outer periphery of the polishing layer 72. Therefore, the polishing liquid 74 supplied to the grooves 72*d* can be prevented from flowing out from the outer periphery side of the polishing layer 72, and the polishing liquid 74 can be made to remain between the polishing pad 48 and the workpiece 1.

As above-mentioned, the polishing pad 48 according to the present embodiment includes the plurality of through-holes 72*c* formed to penetrate the polishing layer 72 vertically, and the plurality of grooves 72*d* which are formed on the lower surface 72*b* side of the polishing layer 72 and are coupled with the through-holes 72*c*. With this polishing pad 48 used, the polishing liquid 74 is easily supplied to the entire region on the lower surface 72*b* side of the polishing layer 72, and the polishing liquid 74 can be suitably supplied to the area between the polishing layer 72 and the workpiece 1. In addition, the polishing pad 48 according to the present embodiment can be manufactured by a comparatively easy method of forming the polishing layer 72 with the through-holes 72*c* and the grooves 72*d*. Therefore, the need for processing of the substrate 70 formed of a metallic material or a resin (polyphenylene sulfide (PPS) or the like), preparation of additional component parts, etc. is eliminated, and labor for manufacture and an increase in cost can be reduced.

Note that while the polishing pad 48 in which the polishing layer 72 is formed with the through-holes 72*c* and the grooves 72*d* has been described in FIG. 3, the mode of the polishing pad is not limited to this. Other modes of the polishing pad will be described in consideration of FIGS. 5 to 8.

Figure 5:
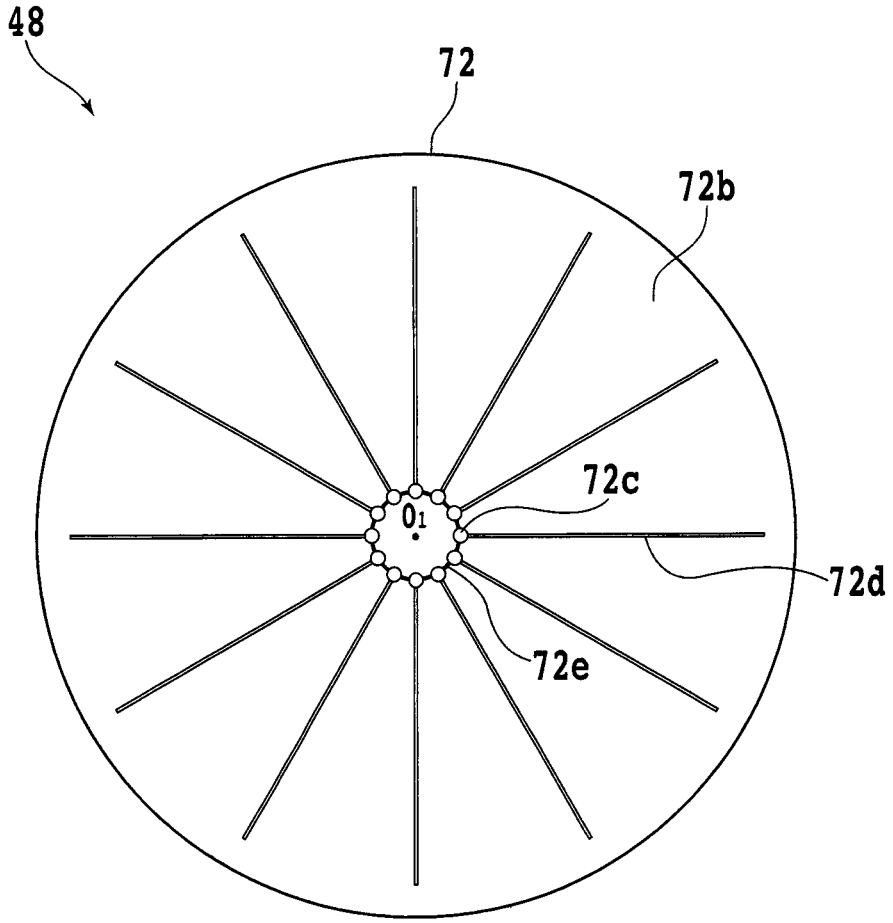
FIG. 5 is a bottom view depicting a modification of the polishing pad illustrated in FIG. 3.

FIG. 5 is a bottom view depicting a modification of the polishing pad 48 illustrated in FIG. 3. The polishing layer 72 depicted in FIG. 5 is formed on its lower surface 72*b* side with a groove 72*e* connected to the plurality of through-holes 72*c*. The groove 72*e* is formed linearly along a circumference (outer periphery) of a circle having a predetermined radius, with the center $O_1$ of the polishing layer 72 as the center of the circle, and is connected with all the through-holes 72*c*. Note that the depth and width of the groove 72*e* are not limited, and can be set, for example, to be the same as those of the grooves 72*d*. With the groove 72*e* thus provided, the polishing liquid 74 (see FIG. 4) supplied to one of the through-hole 72*c* can be supplied to the other through-holes 72*c*. As a result, the polishing liquid 74 can be easily supplied to the whole part of the lower surface 72*b* of the polishing layer 72.

Figure 6:
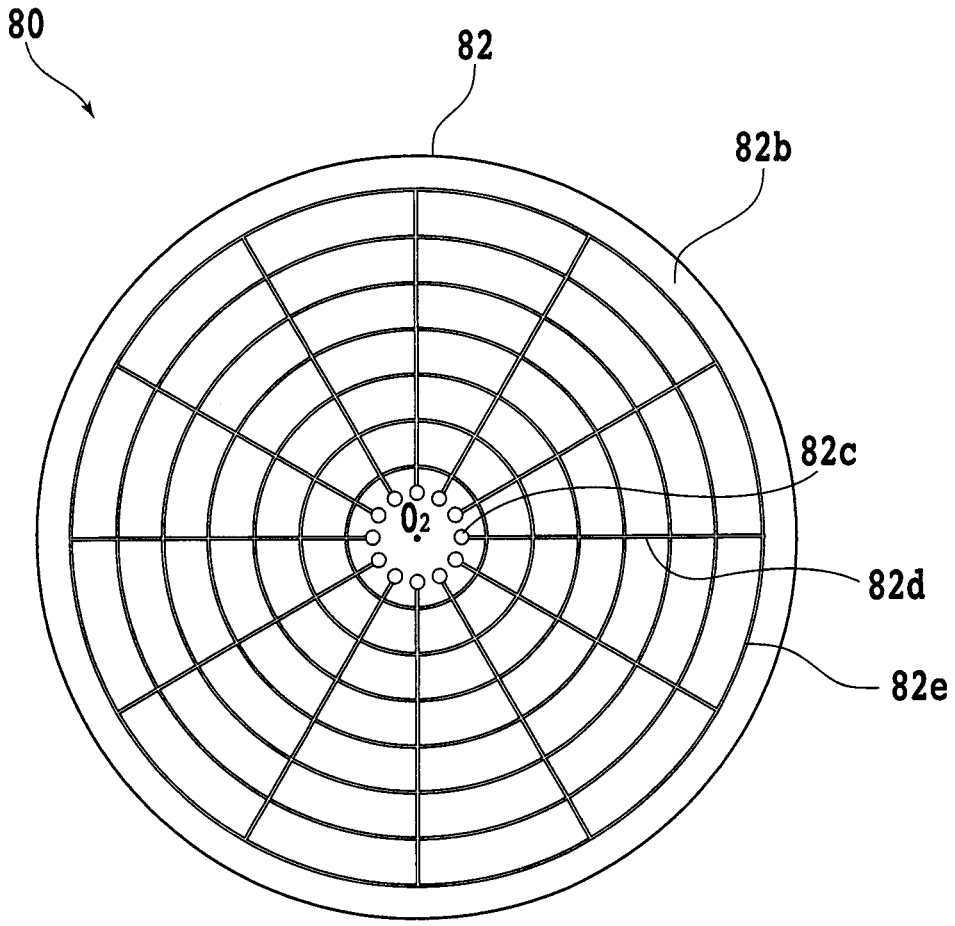
FIG. 6 is a bottom view depicting another polishing pad.

FIG. 6 is a bottom view depicting a polishing pad 80. The polishing pad 80 includes a substrate (not illustrated) having the same structure as that of the substrate 70 depicted in FIG. 3, and a polishing layer 82 fixed to the lower surface side of the substrate. Note that the configurations of the polishing pad 80 which are not described below are the same as those of the polishing pad 48 illustrated in FIG. 3.

The polishing layer 82 is formed in a disk-like shape substantially equal in diameter to the substrate, and a lower surface 82*b* of the polishing layer 82 constitutes a polishing surface for polishing the workpiece 1. Note that the material of the polishing layer 82 is the same as that of the polishing layer 72 depicted in FIG. 3. In addition, the polishing layer 82 is formed with a plurality of through-holes 82*c* and a plurality of first grooves 82*d*. The structures of the through-holes 82*c* and the first grooves 82*d* are the same as those of the through-holes 72*c* and the grooves 72*d* illustrated in FIG. 3.

Further, on the lower surface 82*b* side of the polishing layer 82, a plurality of second grooves 82*e* are formed in a region located on the outer periphery side of the polishing layer 82 as compared to the plurality of through-holes 82*c*. The plurality of second grooves 82*e* are formed linearly along circumferences (outer peripheries) of circles having predetermined radii, with the center $O_2$ of the polishing layer 82 as centers of the circles. In other words, the plurality of second grooves 82*e* are formed concentrically. It is to be noted, however, that the second groove 82*e* formed at a position nearest to the outer periphery of the polishing layer 82 is formed on the inner side as compared to the outer periphery of the polishing layer 82, and is not in contact with the outer periphery of the polishing layer 82. Note that the number of the second grooves 82*e* is not limited.

The second grooves 82*e* are formed to intersect the plurality of first grooves 82*d*, and the first grooves 82*d* and the second grooves 82*e* are connected at the intersections. In other words, the first grooves 82*d* are interconnected through the second grooves 82*e*. Note that the depths and widths of the first grooves 82*d* and the second grooves 82*e* are not limited, and can be set, for example, to be the same as those of the groove 72*d* depicted in FIG. 3.

At the time of polishing the workpiece 1 by use of the polishing pad 80, the polishing liquid 74 (see FIG. 4) flowing into the through-holes 82*c* is supplied also to the inside of the second grooves 82*e* through the first grooves 82*d*. As a result, the polishing liquid 74 is easily supplied also to the regions between the adjacent first grooves 82*d*, and the polishing liquid 74 is more easily supplied to the area between the workpiece 1 and the polishing pad 80. Note that the interval between the through-holes 82*c* and the second groove 82*e* formed at a position nearest to the center $O_2$ of the polishing pad 82 is preferably narrower than the intervals between the second grooves 82*e*. As a result, the polishing liquid 74 (see FIG. 4) supplied to one of the through-holes 82*c* is more easily supplied to the whole region of the lower surface 82*b* of the polishing layer 82.

Figure 7:
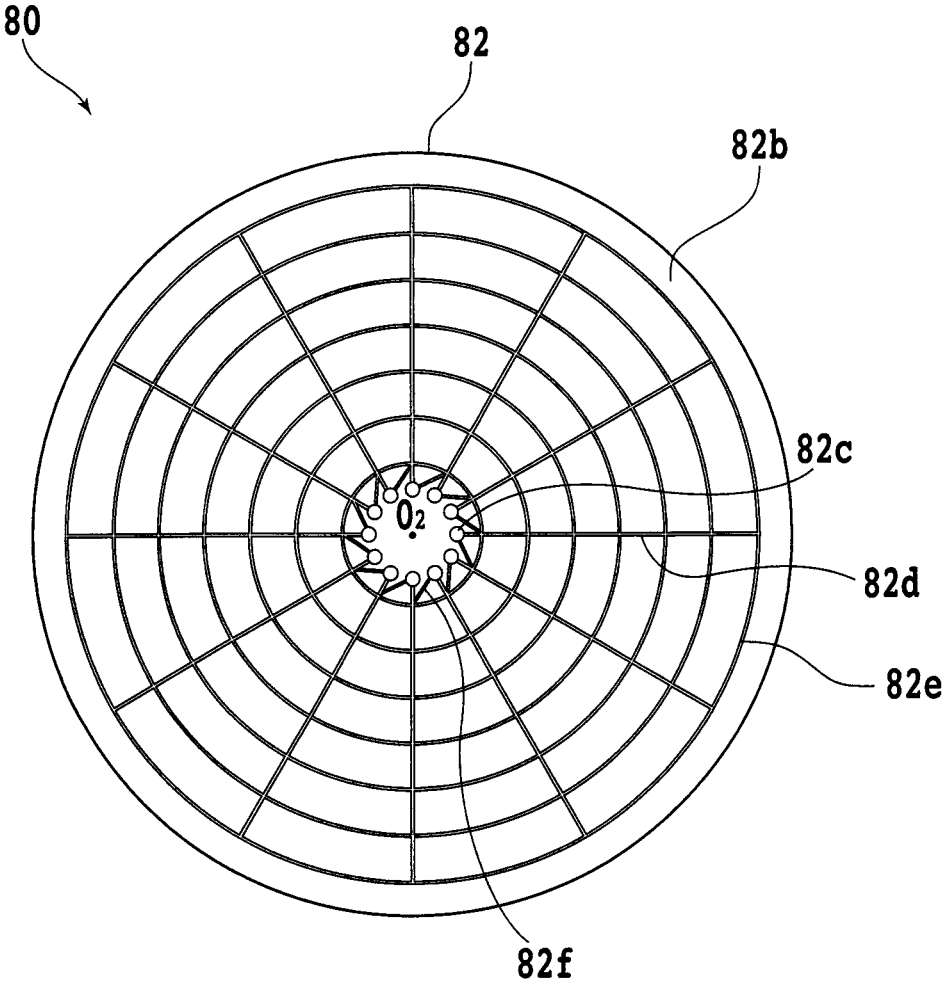
FIG. 7 is a bottom view depicting a modification of the polishing pad illustrated in FIG. 6.

FIG. 7 is a bottom view depicting a modification of the polishing pad 80. The polishing layer 82 depicted in FIG. 7 is further formed on its lower surface 82*b* side with a plurality of third grooves 82*f* connected to the through-holes 82*c* and to the second grooves 82*e* formed at positions nearest to the center $O_2$ of the polishing layer 82. The third groove 82*f* connected to one through-hole 82*c* is connected to the intersection between the first groove 82*d* connected to the other through-hole 82*c* adjacent to the one through-hole 82*c* and the second groove 82*e* formed at a position nearest to the center $O_2$ of the polishing layer 82. Note that the plurality of third grooves 82*f* are formed to extend from the through-hole 82*c* toward the rotating direction (in FIG. 7, the clockwise direction) of the polishing pad 80. In other words, the third groove 82*f* connected to one through-hole 82*c* is formed to extend toward the first groove 82*d* connected to the other through-hole 82*c* adjacent to the one through-hole 82*c* on the rotating direction side of the polishing pad 80. As a result, the polishing liquid 74 supplied to the through-hole 82*c* is easily supplied to the second groove 82*e* by a centrifugal force. Note that the polishing layer 82 may be further formed on its lower surface 82*b* side with a groove connected with the plurality of through-holes 82*c* like in FIG. 5 (see the groove 72*e* in FIG. 5).

Figure 8:
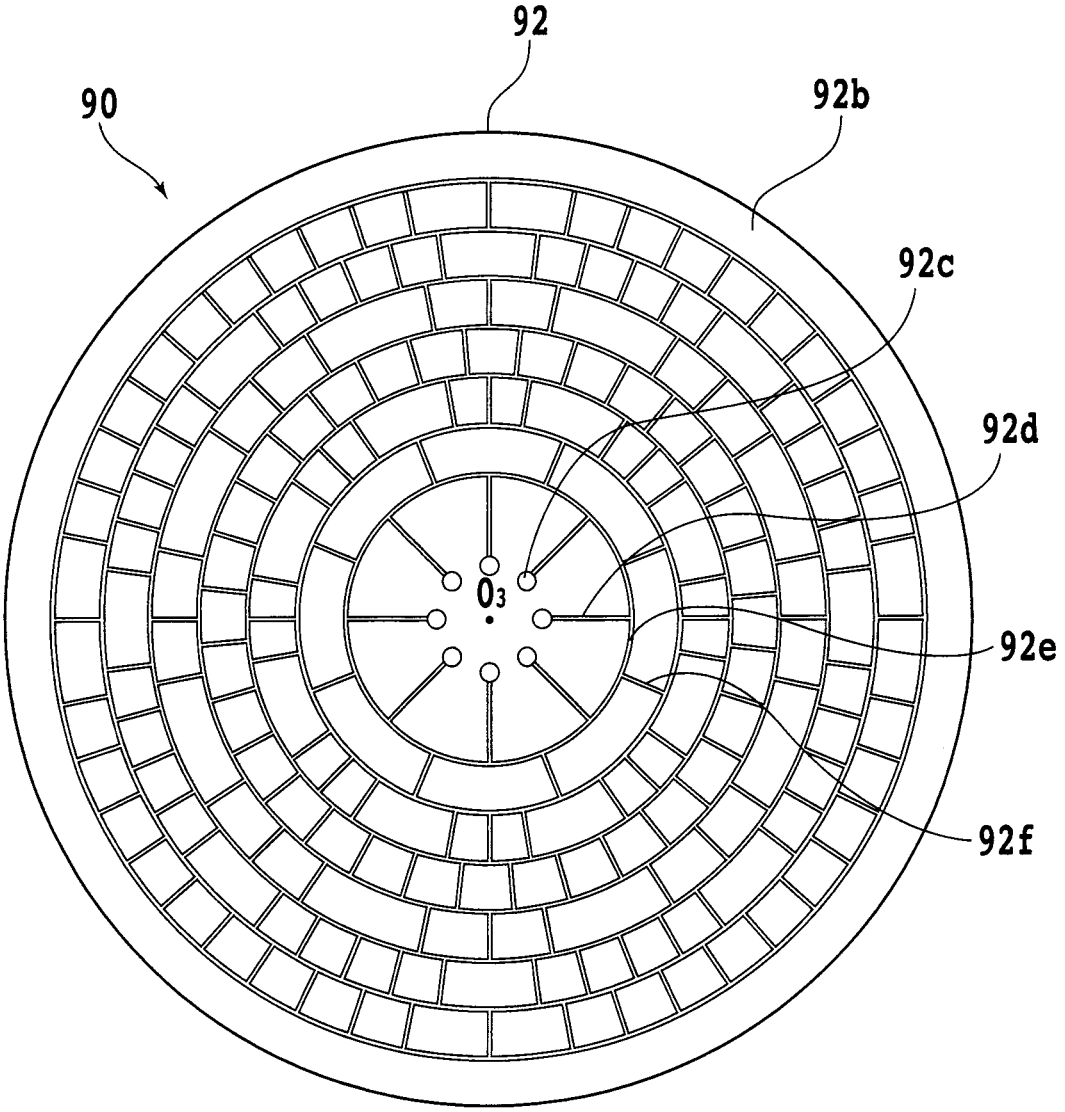
FIG. 8 is a bottom view depicting another polishing pad.

FIG. 8 is a bottom view depicting a polishing pad 90. The polishing pad 90 includes a substrate (not illustrated) having the same structure as that of the substrate 70 depicted in FIG. 3, and a polishing layer 92 fixed to the lower surface side of the substrate. Note that the configurations of the polishing pad 90 which are not described below are the same as those of the polishing pad 48 illustrated in FIG. 3.

The polishing layer 92 is formed in a disk-like shape substantially equal in diameter to the substrate, and a lower surface 92*b* of the polishing layer 92 constitutes a polishing surface for polishing the workpiece 1. Note that the material of the polishing layer 92 is the same as that of the polishing layer 72 depicted in FIG. 3. In addition, the polishing layer 92 is formed with a plurality of through-holes 92*c* and a plurality of first grooves 92*d*. The structures of the through-holes 92*c* and the first grooves 92*d* are the same as those of the through-holes 72*c* and the grooves 72*d* illustrated in FIG. 3. It is to be noted, however, that the first grooves 92*d* are formed to be shorter than the grooves 72*d* depicted in FIG. 3.

In addition, on the lower surface 92*b* side of the polishing layer 92, a plurality of second grooves 92*e* are formed in a region located on the outer periphery side of the polishing layer 92 as compared to the plurality of through-holes 92*c*. The plurality of second grooves 92*e* are formed linearly along circumferences (outer peripheries) of circles having predetermined radii, with the center $O_3$ of the polishing layer 92 as centers of the circles. In other words, the plurality of second grooves 92*e* are formed concentrically.

The second groove 92*e* formed at a position nearest to the center $O_3$ of the polishing layer 92 is connected to the plurality of first grooves 92*d*. In addition, the second groove 92*e* formed at a position nearest to the outer periphery of the polishing layer 92 is formed on an inner side as compared to the outer periphery of the polishing layer 92 and is not in contact with the outer periphery of the polishing layer 92. Note that the number of the second grooves 92*e* is not limited. Further, on the lower surface 92*b* side of the polishing layer 92, pluralities of third grooves 92*f* are formed respectively in regions between the adjacent second grooves 92*e*. The third grooves 92*f* are formed linearly along the radial direction of the lower surface 92*b* of the polishing layer 92, and are connected to the adjacent two second grooves 92*e*. It is to be noted, however, that the third grooves 92*f* are not connected directly with each other, and are connected with each other through the second grooves 92*e*. Note that the depths and widths of the first grooves 92*d*, the second grooves 92*e* and the third grooves 92*f* are not limited, and can be set, for example, to be the same as those of the groove 72*d* depicted in FIG. 3.

At the time of polishing the workpiece 1 by use of the polishing pad 90, the polishing liquid 74 (see FIG. 4) flowing into the through-holes 92*c* is supplied to the inside of the second groove 92*e* formed at a position nearest to the center $O_3$ of the polishing layer 92 through the first grooves 92*d* by centrifugal forces. Then, the polishing liquid 74 supplied to this second groove 92*e* flows alternately along the third grooves 92*f* and the second grooves 92*e*, to be supplied to the second groove 92*e* formed at a position nearest to the outer periphery of the polishing layer 92.

In this way, the polishing liquid 74 is supplied while meandering toward the outer periphery of the polishing layer 92. Therefore, as compared to the cases of using the polishing pads depicted in FIG. 3 and FIGS. 5 to 7, the polishing liquid 74 reaches the outer periphery of the polishing layer 92 with difficulty, so that the polishing liquid 74 is easy to stay in the whole area of the lower surface 92*b* of the polishing layer 92. As a result, the polishing liquid 74 is more easily supplied to the whole part of the lower surface 92*b* of the polishing layer 92. Note that the polishing layer 92 may be further formed on its lower surface 92*b* side with a groove connected with the plurality of through-holes 92*c* like in FIG. 5 (see the groove 72*e* in FIG. 5). In addition, the polishing layer 92 may be further formed on its lower surface 92*b* side with a plurality of grooves connected to the through-holes 92*c* and to the second groove 92*e* formed at a position nearest to the center $O_3$ of the polishing layer 92 like in FIG. 7 (see the third grooves 82*f* in FIG. 7).

Other than the foregoing, the structures, methods and the like according to the above embodiment can be appropriately modified insofar as the modifications do not depart from the scope of the object of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A polishing pad having a disk-shaped substrate and a polishing layer of which an upper surface side, opposite a lower surface side, is adhered to the substrate, wherein the polishing layer includes a plurality of through-holes which are formed to penetrate the polishing layer vertically from the upper surface side to the lower surface side and which are supplied with a polishing liquid, and a plurality of grooves which are formed on the lower surface side of the polishing layer and which are connected to the through-holes, the plurality of through-holes are formed on a central portion of the polishing layer as compared to the plurality of grooves such as to surround a center of the polishing layer, and the plurality of grooves are formed radially from the plurality of through-holes toward an outer periphery of the polishing layer.

2. The polishing pad according to claim 1, wherein a plurality of concentric circular grooves connected to the grooves are formed in a region on the lower surface side of the polishing layer which region is located on the outer periphery side of the polishing layer as compared to the plurality of through-holes.

3. The polishing pad according to claim 1, wherein the grooves connected to the through-holes are formed such as not to reach the outer periphery of the polishing layer.

4. A polishing pad having a disk-shaped substrate and a polishing layer of which an upper surface side, opposite a lower surface side, is adhered to the substrate, wherein the polishing layer includes a plurality of through-holes which are formed to penetrate the polishing layer vertically from the upper surface side to the lower surface side and which are supplied with a polishing liquid, and a plurality of grooves each of which is formed on the lower surface side of the polishing layer and is connected at one end to a corresponding one of the through-holes, the plurality of through-holes are formed such as to surround a center of the polishing layer, and the plurality of grooves are formed radially from the plurality of through-holes toward an outer periphery of the polishing layer.

5. The polishing pad according to claim 4, wherein the substrate includes a though-hole for supplying the polishing liquid to the through-holes of the polishing layer, and a central part of the through-hole of the substrate is covered with a portion of the polishing layer surrounded by the plurality of through-holes of the polishing layer to restrict flow of the polishing liquid to the lower surface side of the polishing layer.

6. The polishing pad according to claim 4 further comprising a circular groove connected to each of the plurality of through-holes.

7. The polishing pad according to claim 1, wherein the substrate includes a though-hole for supplying the polishing liquid to the through-holes of the polishing layer, and a central part of the through-hole of the substrate is covered with a portion of the polishing layer surrounded by the plurality of through-holes of the polishing layer to restrict flow of the polishing liquid to the lower surface side of the polishing layer.

* * * * *